US007688042B2

(12) United States Patent
Wong et al.

(10) Patent No.: US 7,688,042 B2
(45) Date of Patent: Mar. 30, 2010

(54) POWER FACTOR CORRECTION APPARATUS

(75) Inventors: Shih-Fang Wong, Taipei Hsien (TW); Tsung-Jen Chuang, Taipei Hsien (TW); Jun Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 273 days.

(21) Appl. No.: 11/770,747

(22) Filed: Jun. 29, 2007

(65) Prior Publication Data

US 2008/0157727 A1 Jul. 3, 2008

(30) Foreign Application Priority Data

Dec. 29, 2006 (CN) ..... 2006 1 0064637

(51) Int. Cl.
*G05F 1/70* (2006.01)

(52) U.S. Cl. ..... 323/209; 323/207

(58) Field of Classification Search ..... 363/34–41, 363/58, 60, 127, 132; 323/205, 209, 210, 323/215, 207; 702/60, 67

See application file for complete search history.

(56) References Cited

U.S. PATENT DOCUMENTS 5,670,864 A * 9/1997 Marx et al. ..... 323/211
6,025,701 A 2/2000 Weinhold
7,142,997 B1 11/2006 Widner

* cited by examiner

*Primary Examiner*—Rajnikant B Patel
(74) *Attorney, Agent, or Firm*—Frank R. Niranjan

(57) ABSTRACT

A power factor correction apparatus is for correcting a power factor of transmission lines. The power factor correction apparatus includes a switch, a compensator, a detecting apparatus, a voltage processing circuit, a voltage comparison unit, and a time-delay unit. The switch is electrically connected to the transmission lines. The compensator is electrically connected to the switch for compensating the power factor. The detecting apparatus is electrically connected to the transmission lines for detecting voltages transmitted in the transmission lines. The voltage processing circuit electrically is connected to the detecting apparatus and the switch. The voltage processing circuit includes a voltage comparison unit and a time-delay unit. The voltage comparison unit is electrically connected to the detecting apparatus for comparing the voltages with each other to generate a voltage. The time-delay unit is electrically connected to the voltage comparison unit and the switch delaying the voltage.

20 Claims, 3 Drawing Sheets

POWER FACTOR CORRECTION APPARATUS

BACKGROUND OF THE INVENTION

1. Field of the Invention

The present invention generally relates to a power factor correction apparatus.

2. Description of Related Art

The apparent power generated by a three-phase generator is transmitted in transmission lines to various loads, such as an electric motor. In theory, the apparent power has been divided into two parts: one part is an active power actually being consumed by the loads, and the other part is a reactive power wasted in electromagnetic actions occurring in the transmission lines. In order to depict a relationship between these powers, a power factor is defined as a ratio of the active power to the apparent power.

In practice, in order to save the reactive power wasted in electromagnetic actions in the transmission lines, the active power needs to be increased, i.e., the power factor needs to be increased. Normally, a capacitor is connected in parallel with the electric motor to increase the power factor. There are two correction methods for correcting the power factor available in the market, including a static correction method and a dynamic correction method.

The static correction method includes the following steps of: predetermining a power factor according to the state of the transmission lines, choosing a capacitor corresponding to the power factor, connecting the capacitor to the transmission lines. However, the state of the transmission lines often varies, so the static correction method cannot accurately correct the power factor when the state is changed.

The dynamic correction method includes the following steps of: predetermining a power factor according to state of transmission lines, presetting a range of the power factor, choosing a plurality of capacitors according to the range of the power factor, connecting the capacitors to a microcomputer, determining when the capacitors is electrically connected to the transmission lines and how many capacitors are electrically connected to the transmission lines. Accordingly, the dynamic correction method can correct the power factor dynamically even if the state of the transmission lines changes.

Referring to FIG. 3, a three-phase generator 70 is connected to a load 80 via transmission lines 10. A conventional dynamic power factor correction apparatus 11 is used for correcting a power factor of the transmission lines 10. The dynamic power factor correction apparatus 11 includes a first sample circuit 20, a second sample circuit 30, a microcomputer 40, a switch 50, and a compensator 60. The first sample circuit 20 and the second sample circuit 30 are electrically connected to the transmission lines 10. The microcomputer 40 is electrically connected to the first sample circuit 20 and the second sample circuit 30. The switch 50 is electrically connected to the microcomputer 40, the compensator 60, and the transmission lines 10.

The first sample circuit 20 samples a voltage from the transmission lines 10. The second sample circuit 30 samples a current from the transmission lines 10. The microcomputer 40 receives the voltage and the current, and generates a control signal. The switch 50 receives the control signal, and is closed to electrically connect the compensator 50 to the transmission lines 10.

However, the microcomputer is expensive, making the power factor correction apparatus also expensive.

Therefore, a power factor correction apparatus is needed in the industry to address the aforementioned deficiencies and inadequacies.

SUMMARY OF THE INVENTION

A power factor correction apparatus is for correcting a power factor of transmission lines. The power factor correction apparatus includes a switch, a compensator, a detecting apparatus, a voltage processing circuit, a voltage comparison unit, and a time-delay unit. The switch is electrically connected to the transmission lines. The compensator is electrically connected to the switch for compensating the power factor. The detecting apparatus is electrically connected to the transmission lines for detecting voltages transmitted in the transmission lines. The voltage processing circuit electrically is connected to the detecting apparatus and the switch. The voltage processing circuit includes a voltage comparison unit and a time-delay unit. The voltage comparison unit is electrically connected to the detecting apparatus for comparing the voltages with each other to generate a voltage. The time-delay unit is electrically connected to the voltage comparison unit and the switch for delaying the voltage.

Other systems, methods, features, and advantages of the present power factor correction apparatus will be or become apparent to one with skill in the art upon examination of the following drawings and detailed description. It is intended that all such additional systems, methods, features, and advantages be included within this description, be within the scope of the present device, and be protected by the accompanying claims.

BRIEF DESCRIPTION OF THE DRAWINGS

Many aspects of the present power factor correction apparatus can be better understood with reference to following drawings. Components in the drawings are not necessarily to scale, emphasis instead being placed upon clearly illustrating the principles of the present device. Moreover, in the drawings, like reference numerals designate corresponding parts throughout the several views.

DETAILED DESCRIPTION OF THE INVENTION

Reference will now be made to the drawings to describe a preferred embodiment of the present switching regulator.

Figure 1:
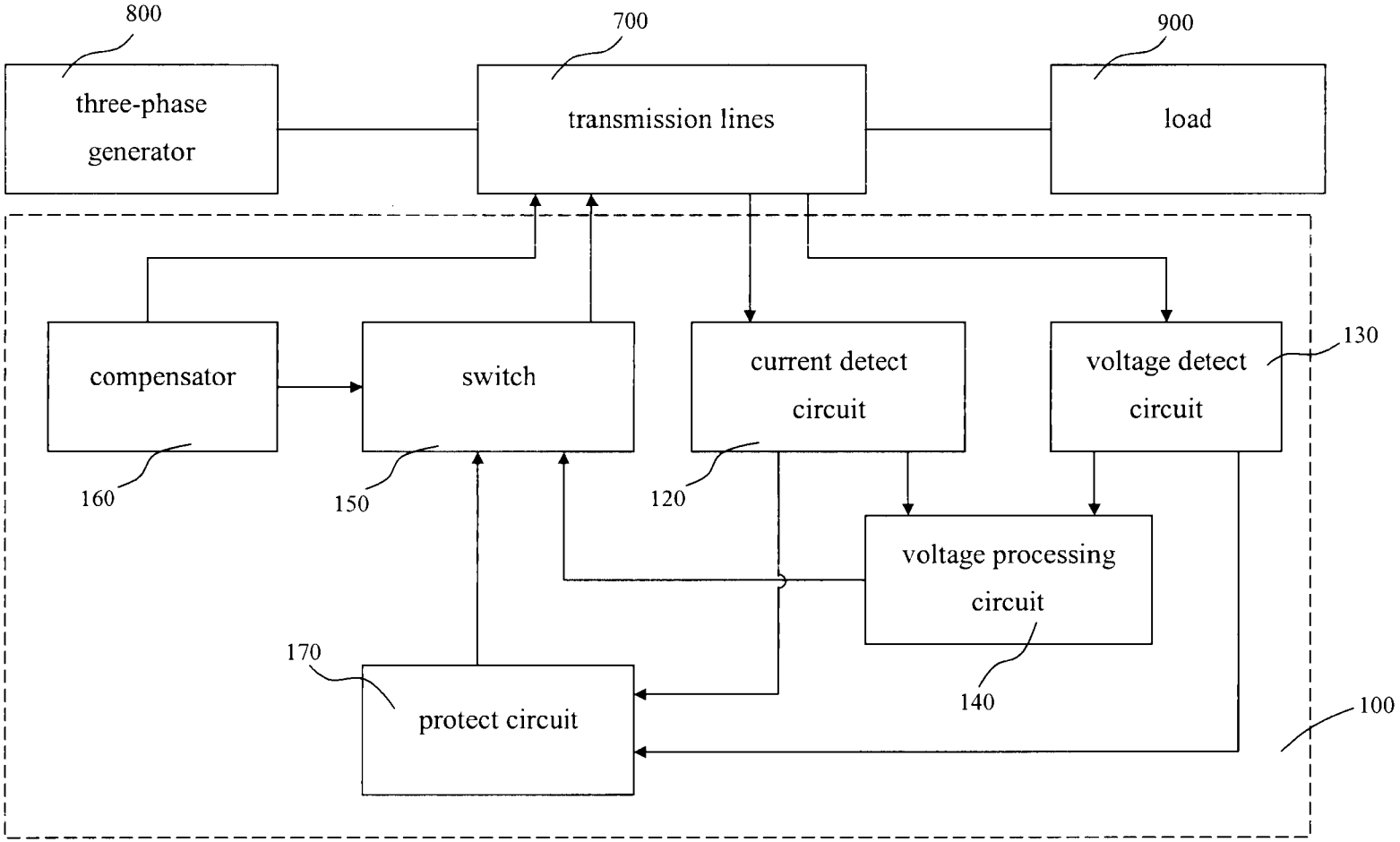
FIG. 1 is a block diagram showing a power factor correction apparatus in accordance with an exemplary embodiment.

Referring to FIG. 1, a three-phase generator 800 is connected to a load 900 via transmission lines 700. A power factor correction apparatus 100 in accordance with a preferred exemplary embodiment is used for correcting a power factor of the transmission lines 700. The power factor correction apparatus 100 includes a current detect circuit 120, a voltage detect circuit 130, a voltage processing circuit 140, a switch 150, a compensator 160, and a protect circuit 170. The current detect circuit 120 and the voltage detect circuit 130 can be combined to be a detecting apparatus.

Both the current detect circuit 120 and the voltage detect circuit 130 are electrically connected to the transmission lines 700. The voltage processing circuit 140 is electrically connected to the current detect circuit 120 and the voltage detect circuit 130. The switch 150 is electrically connected to the voltage processing circuit 140 and the transmission lines 700. The compensator 160 is electrically connected to the switch 150 and the transmission lines 700. The protect circuit 170 is electrically connected to the current detect circuit 120, the voltage detect circuit 130, and the switch 150.

The current detect circuit 120 is used for detecting a phase current transmitted in the transmission lines 700, and generating a first voltage based on the phase current. The voltage detect circuit 130 is for detecting a line-to-line voltage transmitted in the transmission lines 700, and generating a second voltage based on the line-to-line voltage. The voltage processing circuit 140 is for receiving the first voltage and the second voltage, and generating a control signal if the first voltage is greater than the second voltage. The switch 150 is closed to electrically connect the compensator 160 to the transmission lines 700 based on the control signal. The protect circuit 170 is for receiving the first voltage and the second voltage, and generating a protecting signal. The switch 150 is configured to be opened when the protecting signal is received. When hazardous conditions such as a short circuit or an overcurrent occur, the protect circuit 170 protects the compensator 160 from being damaged.

Figure 2:
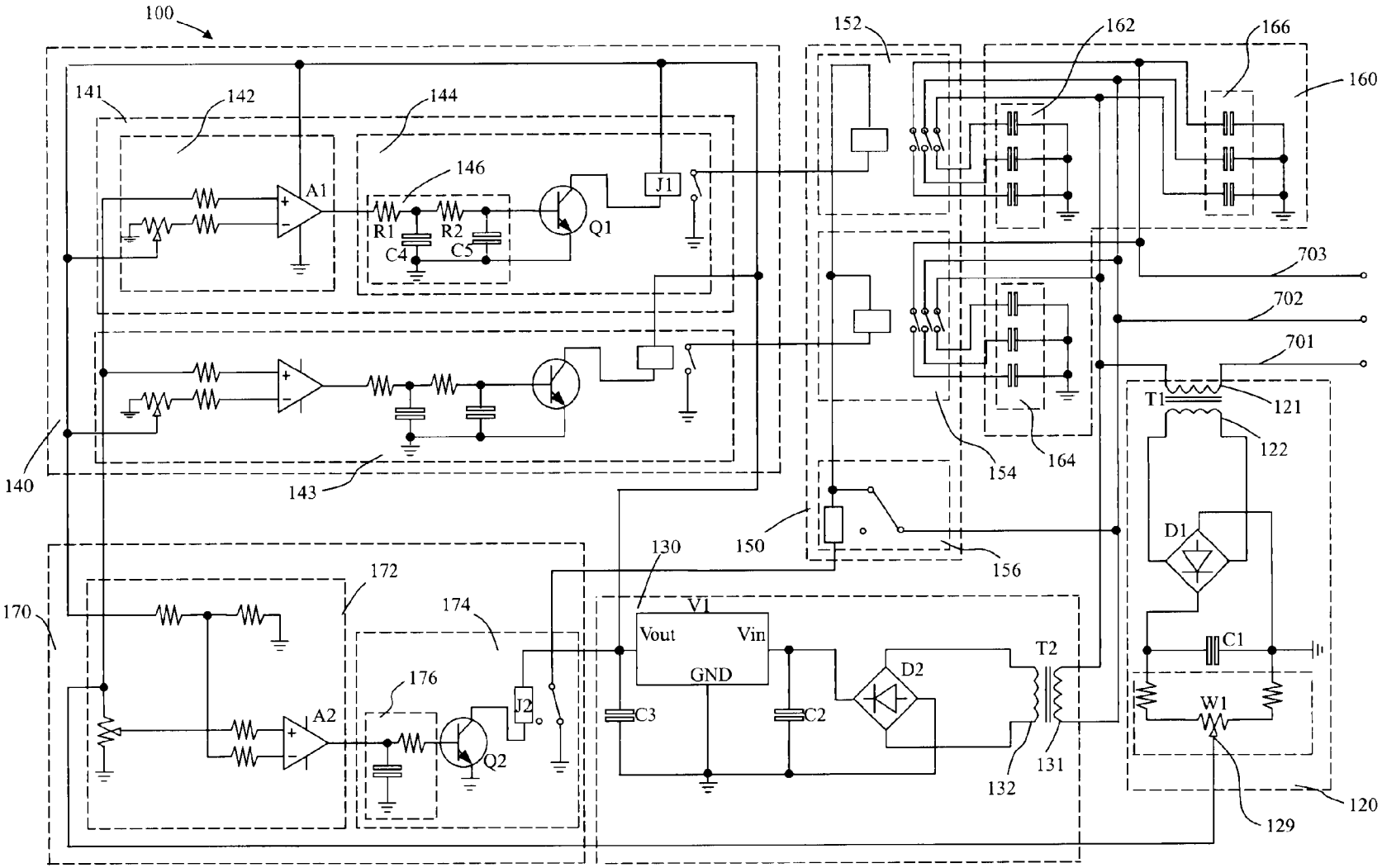
FIG. 2 is a schematic diagram showing a concrete structure of the power factor correction apparatus of FIG. 1.
Figure 3:
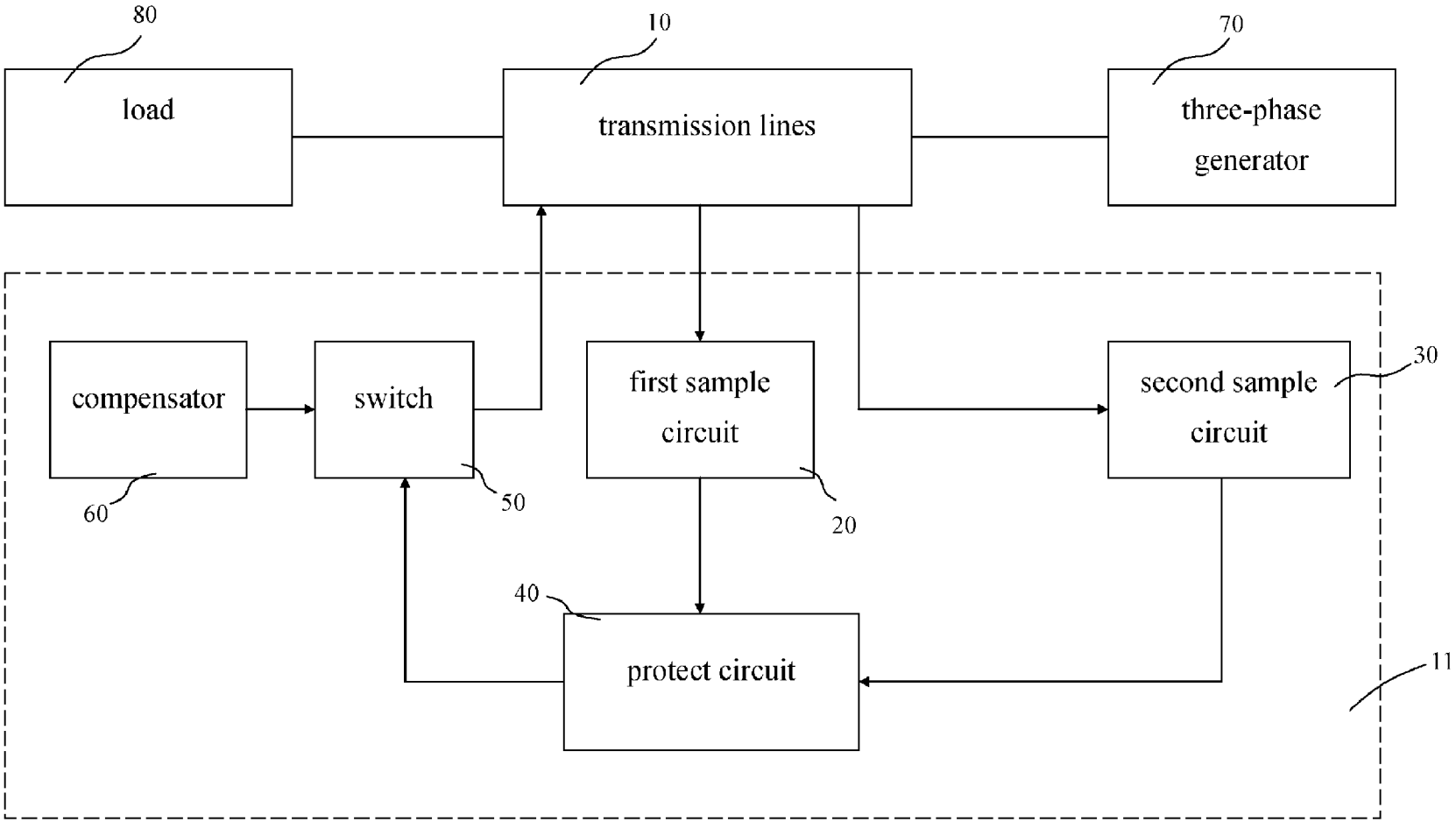
FIG. 3 (RELATED ART)
FIG. 3 is a block diagram showing a conventional power factor correction apparatus.

Referring to FIG. 2, the power factor correction apparatus 100 is electrically connected to three live lines 701, 702, 703. The current detect circuit 120 is electrically connected to the live line 701 to receive a current transmitted in the live line 701. The current detect circuit 120 includes a transformer T1, a rectifier D1, a filter C1, and a variable resistor W1. A primary coil 121 of the transformer T1 receives the current transmitted in the live line 701, and a secondary coil 122 generates a first induced voltage. The first induced voltage is rectified by the rectifier D1 and filtered by the filter C1, and then divided by the variable resistor W1. A wiper 129 of the variable resistor W1 outputs the first voltage.

The voltage detect circuit 130 includes a transformer T2, a rectifier D2, a filter C2, a three-terminal regulator V1, and a filter C3. A primary coil 131 is electrically connected to the live lines 701, 702, to receive a voltage between the live lines 701, 702. A secondary coil 132 generates a second induced voltage. The second induced voltage is rectified by the rectifier D1 and filtered by the filter C1, and then received by an input terminal Vin of the three-terminal regulator V1. An output Vout of the three-terminal regulator V1 outputs the second voltage filtered by the filter C3.

The voltage processing circuit 140 includes a first voltage processing module 141 and a second voltage processing module 143. The first voltage processing module 141 and the second voltage processing module 143 are used for processing the first voltage and the second voltage respectively. The first voltage processing module 141 generates a first on signal if a difference between the first voltage and the second voltage is within a first predetermined range, and the second voltage processing module 143 generates a second on signal if the difference between the first voltage and the second voltage is greater than the first predetermined range and within a second predetermined range. The first voltage processing module 141 and the second voltage processing module 143 have similar structures and functions. Hereinafter, the first voltage processing module 141 is depicted as an example for the first voltage processing module 141 and the second voltage processing module 143.

The first voltage processing module 141 includes a voltage comparison unit 142 and a time-delay unit 144. The voltage comparison unit 142 is electrically connected to the current detect circuit 120 and the voltage detect circuit 130, to receive the first voltage and the second voltage. The voltage comparison unit 142 compares the first voltage with the second voltage thereby generating a third voltage if the first voltage is greater than the second voltage and the difference between the first voltage and the second voltage is within the first predetermined range. The time-delay unit 144 is electrically connected to the voltage comparison unit 142 and the switch 150 to delay outputting the third voltage and outputs the first on signal.

The voltage comparison unit 142 includes an operational amplifier A1. A noninverting input of the operational amplifier A1 is electrically connected to a wiper 129 of the variable resistor W1 via a resistor. An inverting input is electrically connected to the output Vout of the three-terminal regulator V1 via a resistor and a variable resistor. An output of the voltage comparison unit 142 is electrically connected to the time-delay unit 144.

The time-delay unit 144 includes a RC network 146, a bipolar junction transistor (BJT) Q1, and a first relay J1. An end of the first RC network is electrically connected to the output of the operational amplifier A1, and another end of the RC network 146 is electrically connected to a base of the BJT Q1. An emitter of the BJT Q1 is connected to ground, and a collector of the BJT Q1 is electrically connected to the first relay J1. The first relay J1 is electrically connected to the switch 150 and the output Vout of the three-terminal regulator V1 of the voltage detect circuit 130.

The RC network 146 includes a first resistor R1, a second resistor R2, a first capacitor C4, and a second capacitor C5. A first end of the first resistor R1 is electrically connected to the output of the voltage comparison unit 142, and a second end of the first resistor R1 is electrically connected to a first end of the second resistor R2. A second end of the second resistor R2 is electrically connected to the base of the BJT Q1. An end of the first capacitor C4 is electrically connected to the second end of the first resistor R1, and another end of the first capacitor C4 is connected to ground. An end of the second capacitor C5 is electrically connected to the second end of the second resistor R2, and another end of the second capacitor C5 is connected to ground.

The switch 150 includes two second relays 152, 154 and a third relay 156 connected together in series. The second relay 152 is electrically connected to the first voltage processing module 141, to be closed when receiving the first on signal. The second relay 154 is electrically connected to the second voltage processing module 143 to receive the second on signal, and is closed when receiving the on signal. The third relay 156 is electrically connected to the protect circuit 170 and the live line 702. Under normal conditions, the third relay 156 is closed, and leads the voltage to the second relays 152, 154. When hazardous conditions occur, the third relay 156 receives the protecting signal and is opened. The second relays 152, 154 would not be able to receive the voltage, and both are opened.

The compensator 160 includes three capacitor groups 162, 164, 166. The capacitor group 162 is electrically connected to the three live lines 701 via the second relay 152. The capacitor group 164 is electrically connected to the three live lines 701, 702, 703 via the second relay 154. The capacitor group 166 is electrically connected to the three live lines 701, 702, 703. In this embodiment, the capacitor groups 162, 164 function as dynamic correcting units, while the capacitor group 166 functions as static correcting unit.

The protect circuit 170 has a similar structure with the first voltage processing module 141 of the voltage processing circuit 140. The protect circuit 170 includes a voltage comparison unit 172 and a time-delay unit 174. The voltage comparison unit 172 is electrically connected to the current detect circuit 120 and the voltage detect circuit 130, to receive the first voltage and the second voltage. The voltage comparison unit 172 compares the first voltage with the second voltage, and generates a fourth voltage if the first voltage is much more greater than the second voltage and the difference between the first voltage and the second voltage is greater than the second predetermined range. The time-delay unit 174 is electrically connected to the voltage comparison unit 172 and the switch 150, to delay the fourth voltage and output the protecting signal. The voltage comparison unit 172 includes an operational amplifier A2 to compare the first voltage with the second voltage to generate the fourth voltage. The time-delay unit 144 includes a RC network 176, a BJT Q2, and a fourth relay J2 connected together in series.

The voltage processing circuit 140 and the switch 150 are used to control the compensator 160 in the power factor correction apparatus 100. Herein, the voltage processing circuit 140 and the switch 150 are composed of ordinary electronic components, such as operational amplifier, BJT, resistor, capacitor, and relay. Therefore, the power factor correction apparatus 100 is cheaper.

It should be emphasized that the above-described preferred embodiment, is merely a possible example of implementation of the principles of the invention, and is merely set forth for a clear understanding of the principles of the invention. Many variations and modifications may be made to the above-described embodiment of the invention without departing substantially from the spirit and principles of the invention. All such modifications and variations are intended to be included herein within the scope of this disclosure and the present invention and be protected by the following claims.

What is claimed is:

1. A power factor correction apparatus for correcting a power factor of transmission lines, the power factor correction apparatus comprising:

a switch electrically connected to the transmission lines;

a compensator electrically connected to the switch for compensating the power factor;

a detecting apparatus electrically connected to the transmission lines for detecting voltages transmitted in the transmission lines; and a voltage processing circuit electrically connected to the detecting apparatus and the switch, the voltage processing circuit comprising:

a voltage comparison unit comprising an operational amplifier electrically connected to the detecting apparatus for comparing the voltages with each other to generate a voltage; and a time-delay unit electrically connected to the voltage comparison unit and the switch for delaying the voltage;

wherein the detecting apparatus comprises a current detect circuit electrically connected to a noninverting input of the operational amplifier via a resistor, and a voltage detect circuit electrically connected to an inverting input of the operational amplifier via a resistor and a variable resistor.

2. The power factor correction apparatus according to claim 1, wherein the current detect circuit comprises a transformer electrically connected to the transmission lines for detecting a phase current.

3. The power factor correction apparatus according to claim 1, wherein the voltage detect circuit comprises a transformer electrically connected to the transmission lines for detecting a line-to-line voltage.

4. The power factor correction apparatus according to claim 1, wherein the time-delay unit comprises an RC network electrically connected to the voltage comparison unit, a bipolar junction transistor with a base electrically connected to the RC network and an emitter electrically connected to ground, and a relay electrically connected to a collector of the bipolar junction transistor.

5. The power factor correction apparatus according to claim 4, wherein the RC network comprises a first resistor, a second resistor, a first capacitor, and a second capacitor, and a first end of the first resistor is electrically connected to the voltage comparison unit, and a second end of the first resistor is electrically connected to a first end of the second resistor, and a second end of the second resistor is electrically connected to the base of the bipolar junction transistor, and an end of the first capacitor is electrically connected to the second end of the first resistor, and another end of the first capacitor is connected to ground, and an end of the second capacitor is electrically connected to the second end of the second resistor, and another end of the second capacitor is connected to ground.

6. The power factor correction apparatus according to claim 1, further comprising a protect circuit electrically connected to the detecting apparatus and the switch for receiving the voltages and generating a protecting signal for opening the switch.

7. The power factor correction apparatus according to claim 6, wherein the switch comprises a first relay electrically connected to the transmission lines and the protect circuit, and a second relay electrically connected to the first relay, the time-delay unit, and the compensator.

8. A power factor correction apparatus for correcting a power factor of transmission lines, the power factor correction apparatus comprising:

a detecting apparatus for generating a first voltage by detecting a phase current in the transmission lines and generating a second voltage by detecting a line-to-line voltage in the transmission lines;

a voltage comparison unit comprising an operational amplifier for comparing the first voltage with the second voltage to generate a third voltage when the first voltage is greater than the second voltage;

a time-delay unit comprising an RC network for delaying the third voltage and outputting an on signal; and a switch for receiving the on signal and being closed to electrically connect a compensator to the transmission lines.

9. The power factor correction apparatus according to claim 8, wherein the RC network comprises a first resistor, a second resistor, a first capacitor, and a second capacitor, and a first end of the first resistor is electrically connected to the voltage comparison unit, and a second end of the first resistor is electrically connected to a first end of the second resistor, and a second end of the second resistor is electrically connected to the time-delay unit, and an end of the first capacitor is electrically connected to the second end of the first resistor, and another end of the first capacitor is connected to ground, and an end of the second capacitor is electrically connected to the second end of the second resistor, and another end of the second capacitor is connected to ground.

10. The power factor correction apparatus according to claim 8, wherein the detecting apparatus comprises a current detect circuit, the current detect circuit comprising:

a transformer for detecting the phase current, and generating an induced voltage;

a rectifier for rectifying the induced voltage;

a filter for smoothing the induced voltage; and a variable resistor for dividing the induced voltage and outputting the first voltage.

11. The power factor correction apparatus according to claim 8, wherein the detecting apparatus comprises a voltage detect circuit, the voltage detect circuit comprising:

a transformer for detecting the line-to-line voltage, and generating an induced voltage;

a rectifier for rectifying the induced voltage;

a filter for smoothing the induced voltage; and a three-terminal regulator for converting the induced voltage to the second voltage.

12. The power factor correction apparatus according to claim 8, further comprising a protect circuit for receiving the first voltage and the second voltage, and outputting a protecting signal for opening the switch.

13. The power factor correction apparatus according to claim 12, wherein the switch comprises a first relay and a second relay, and the first relay is for leading a voltage from the transmission lines to the second relay.

14. The power factor correction apparatus according to claim 13, wherein the second relay is for receiving the on signal and the voltage and being closed to electrically connect the compensator to the transmission lines.

15. A power factor correction apparatus for correcting a power factor of transmission lines comprising:

a detecting apparatus for generating a first voltage by detecting a phase current in the transmission lines and generating a second voltage by detecting a line-to-line voltage in the transmission lines;

a voltage comparison unit for comparing the first voltage with the second voltage to generate a third voltage when the first voltage is greater than the second voltage;

a time-delay unit for delaying the third voltage and outputting an on signal;

a switch for receiving the on signal and being closed to electrically connect a compensator to the transmission lines, the switch comprising a first relay and a second relay, the first relay being for leading a fourth voltage from the transmission lines to the second relay; and a protect circuit for receiving the first voltage and the second voltage, and outputting a protecting signal for opening the switch.

16. The power factor correction apparatus according to claim 15, wherein the voltage comparison unit comprises an operational amplifier for comparing the first voltage with the second voltage to generate the third voltage.

17. The power factor correction apparatus according to claim 15, wherein the time-delay unit comprises an RC network for delaying the third voltage.

18. The power factor correction apparatus according to claim 17, wherein the RC network comprises a first resistor, a second resistor, a first capacitor, and a second capacitor, and a first end of the first resistor is electrically connected to the voltage comparison unit, and a second end of the first resistor is electrically connected to a first end of the second resistor, and a second end of the second resistor is electrically connected to the time-delay unit, and an end of the first capacitor is electrically connected to the second end of the first resistor, and another end of the first capacitor is connected to ground, and an end of the second capacitor is electrically connected to the second end of the second resistor, and another end of the second capacitor is connected to ground.

19. The power factor correction apparatus according to claim 15, wherein the detecting apparatus comprises a current detect circuit, the current detect circuit comprising:

a transformer for detecting the phase current, and generating an induced voltage;

a rectifier for rectifying the induced voltage;

a filter for smoothing the induced voltage; and a variable resistor for dividing the induced voltage and outputting the first voltage.

20. The power factor correction apparatus according to claim 15, wherein the second relay is for receiving the on signal and the fourth voltage and being closed to electrically connected the compensator to the transmission lines.

* * * * *